US011217080B2

(12) United States Patent
Balakrishnan et al.

(10) Patent No.: US 11,217,080 B2
(45) Date of Patent: Jan. 4, 2022

(54) ARTIFICIAL INTELLIGENCE DRIVEN SMART CHILD SAFETY SYSTEM

(71) Applicants: Sarathi Thasan Balakrishnan, Columbus, IN (US); Sharmila Vivekanandan, Columbus, IN (US)

(72) Inventors: Sarathi Thasan Balakrishnan, Columbus, IN (US); Sharmila Vivekanandan, Columbus, IN (US)

( * ) Notice: Subject to any disclaimer, the term of this patent is extended or adjusted under 35 U.S.C. 154(b) by 0 days.

(21) Appl. No.: 17/095,685

(22) Filed: Nov. 11, 2020

(65) Prior Publication Data

US 2021/0142644 A1 May 13, 2021

Related U.S. Application Data

(60) Provisional application No. 62/934,682, filed on Nov. 13, 2019.

(51) Int. Cl.

| | |
|---|---|
| ***G08B 21/04*** | (2006.01) |
| ***G08B 21/24*** | (2006.01) |
| ***G08B 25/00*** | (2006.01) |

(52) U.S. Cl.

CPC ..... *G08B 21/0476* (2013.01); *G08B 21/0492* (2013.01); *G08B 21/24* (2013.01); *G08B 25/005* (2013.01)

(58) Field of Classification Search

CPC ..... G08B 21/0476

See application file for complete search history.

(56) References Cited

U.S. PATENT DOCUMENTS

| | | | | |
|---|---|---|---|---|
| 6,819,249 | B1 | 11/2004 | Papp | |
| 7,714,737 | B1 | 5/2010 | Morningstar | |
| 9,378,641 | B2 | 6/2016 | Beumler | |
| 2017/0015240 | A1* | 1/2017 | Jacobs | G08B 21/24 |
| 2017/0182938 | A1* | 6/2017 | Byrd, I | G08B 21/24 |
| 2017/0305340 | A1* | 10/2017 | Rose | B60N 2/28 |
| 2018/0056814 | A1* | 3/2018 | Tanyi | B60N 2/002 |
| 2018/0130327 | A1* | 5/2018 | Rogers | G08B 21/0222 |
| 2018/0342141 | A1* | 11/2018 | Baker | B60N 2/002 |
| 2019/0098262 | A1 | 3/2019 | Veneziano | |
| 2019/0168635 | A1* | 6/2019 | McLaughlin | B60N 2/28 |
| 2019/0251820 | A1* | 8/2019 | Friedman | B60N 2/002 |

FOREIGN PATENT DOCUMENTS

| | | |
|---|---|---|
| CN | 103646501 A | 3/2014 |

* cited by examiner

*Primary Examiner* — Travis R Hunnings

(57) ABSTRACT

An apparatus of and a method for facilitating an artificial intelligence (AI) driven smart child safety system for motor vehicles provide active and constant monitoring for onboard child safety. The system includes various sensors and an AI controller that uses face recognition and seatbelt recognition technologies to monitor the presence of a child and/or adult through multiple cameras. Thus, the system can send out voice/text/video alarms whenever encountering an unsafe condition and/or emergency if a child is present in the vehicle without an adult, the child's seatbelt is not securely fastened, the vehicle cabin temperature is out of a safe range, the child's body temperature exceeds a predetermined maximum safe temperature, the vehicle is speeding, etc. The voice/text/video alarms are instantly played out via a speaker, a personal computing (PC) device, and/or sent to a local safety authority.

25 Claims, 16 Drawing Sheets

ARTIFICIAL INTELLIGENCE DRIVEN SMART CHILD SAFETY SYSTEM

The current application claims a priority to the U.S. Provisional Patent application Ser. No. 62/934,682 filed on Nov. 13, 2019.

FIELD OF THE INVENTION

The present invention relates generally to artificial intelligence (AI) driven child safety systems and methods. More specifically, the present invention is an AI driven smart child safety apparatus and method for automobiles, which ensures the onboard safety of a child through constantly monitoring the child's safety conditions and immediately alerting and alarming responsible persons and/or authorities in case of unsafe conditions and/or emergency.

BACKGROUND OF THE INVENTION

Regular automobile child safety systems are passive. Seat belts and airbags are insufficient for active child safety and monitoring. The current innovations registered are focused on mechanical or basic electronic switch based alert system, which are not intelligent to be proactive.

AI (artificial intelligence) driven smart child safety system actively monitors the safety points. Using intelligent systems including but not limited to facial recognition using AI, pattern recognition using AI, cabin temperature (heat sensor), pyroelectric ("passive") infrared (PIR) motion sensor, light dependent resistors (LDR) cabin light level.

Presently, there is no solution for holistic and active child safety monitoring system and/or method for vehicles.

SUMMARY OF THE INVENTION

The present invention offers a solution to the problem of lacking holistic and active child safety monitoring systems and/or methods for vehicles by providing an artificial intelligence (AI) driven, active, and smart child safety monitoring and alert system.

While children are on board, the AI driven child safety system checks for adult presence and in-cabin safety. If the adult is not present inside the cabin, a warning alert will be sent to registered owner's mobile device as text and automated voice warnings every 3 minutes. After 3 such warnings, if the adult presence is still not detected inside the cabin, in-car module lights and head lights will be activated. At the $10^{th}$ minute, the hazardous situation along with the automobile geo co-ordinates will be informed to local emergency authorities via text and voice.

This AI based active monitoring system turns on as soon as the child enters the cabin and keeps watch until the child leaves the cabin. If the system detects an unbuckled child with an adult in a moving automobile, the in-module speaker system issues a voice alert in cabin to pull over and buckle the child. This same alert will also be issued when the child happens to slip out of inappropriately secured seat belt.

The AI based active monitoring also ensures the cabin temperature does not cross the safety limits imposed by governmental authorities to prevent sudden infant death syndrome (SIDS) according to the FDA (Federal Drug Administration) and NIH (National Institute of Health). If cabin temperature falls out of a safety range, an in-module speaker system warns the adult in cabin of the suggested temperature to be set in cabin to prevent SIDS.

DETAIL DESCRIPTIONS OF THE INVENTION

Figure 1:
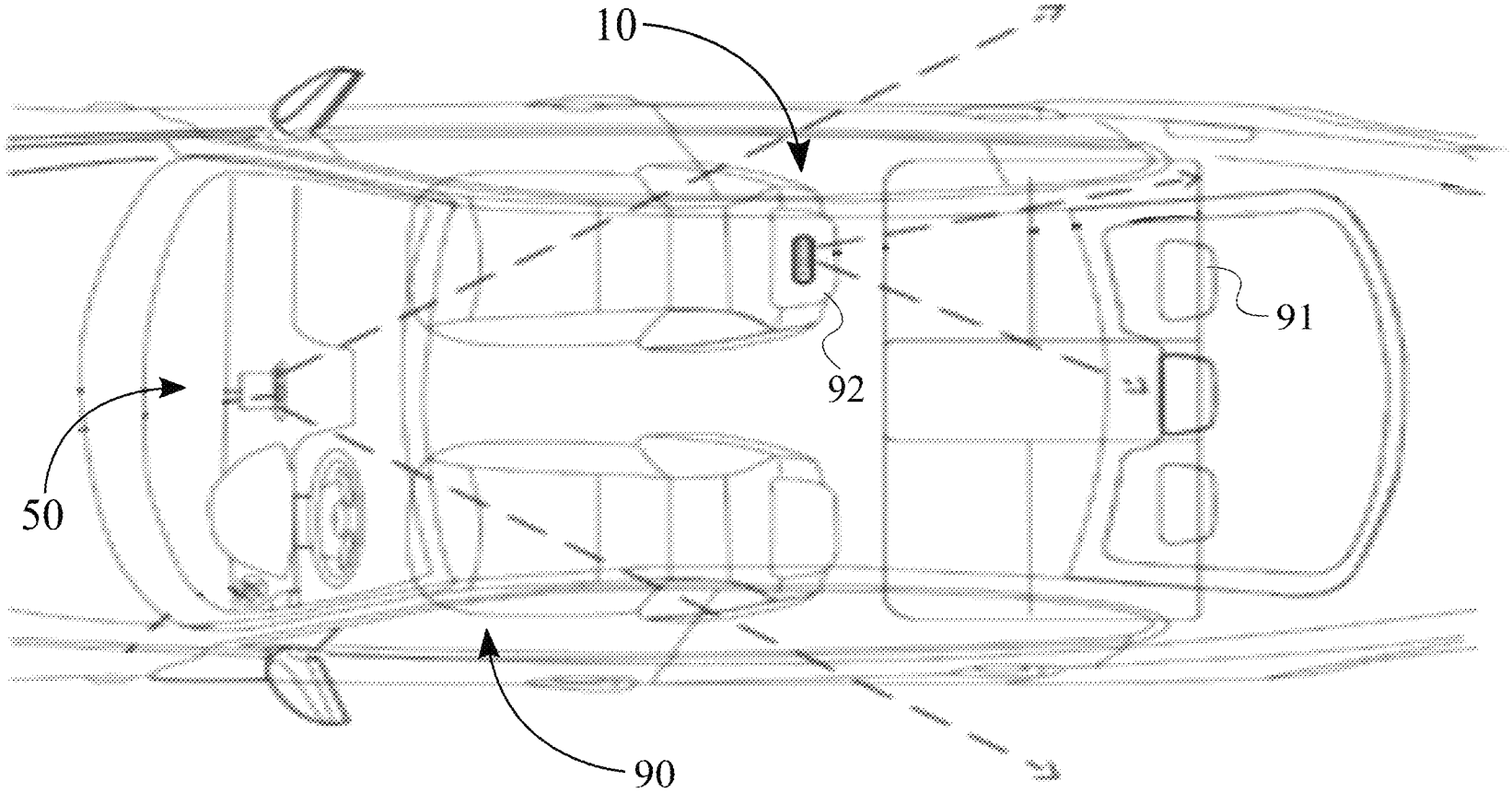
FIG. 1 is a perspective view of the present invention.

All illustrations of the drawings are for the purpose of describing selected versions of the present invention and are not intended to limit the scope of the present invention.

As can be seen in FIG. 1 to FIG. 16, the present invention is an apparatus of and a method for facilitating an artificial intelligence (AI) driven smart child safety system for motor vehicles, wherein a child's safety is being continuously monitored. The present invention sends out alerts and alarms whenever encountering an unsafe condition and/or emergency that include, but are not limited to, a child being present in the vehicle cabin without an adult, a child's seatbelt not being securely fastened, the vehicle cabin temperature being out of safe range, the child's body temperature exceeding a predetermined maximum safe temperature, the vehicle being speeding, etc. The alerts and alarms may be instantly played out via a speaker, a personal computing (PC) device, and/or sent to a local safety authority, including, but not limited to, police department, hospital, care center, emergency first responder, etc. The format of the alerts and alarms may include, but is not limited to, voice, text, video, etc. Additionally, the alerts and alarms may be sent to the PC device of a responsible user for the child and/or the vehicle in a predetermined time interval, for example, once every second, five seconds, 30 seconds, one minute, etc. After a predetermined period of time elapsed, the present invention sends the alerts and alarms to the local safety authority. The predetermined period of time may include, but is not limited to, three minutes, five minutes, 10 minutes, 15 minutes, etc.

As can be seen in FIG. 1 to FIG. 4, the AI driven smart child safety apparatus of the present invention comprises a main module 10, a cabin module 50, and a vehicle cabin 90. The vehicle cabin 90 comprises a child seat 91 and a front seat 92. The front seat 92 is mounted inside the vehicle cabin 90 and the child seat 91 is positioned in the vehicle cabin 90 opposite the front seat 92. The main module 10 is electronically connected to an extraneous power source. Additionally, the main module 10 comprises an artificial intelligence (AI) controller 13, a main motion sensor 16, and at least one main camera 18. Specifically, the AI controller 13 is electronically connected with the main motion sensor 16 and the at least one main camera 18. The cabin module 50 comprises a cabin camera 53 and a cabin motion sensor 54. More specifically, the cabin camera 53 and the cabin motion sensor 54 are electronically connected to the AI controller 13 of the main module 10, which is mounted to the front seat 92 facing the child seat 91 of the vehicle cabin 90. Further, the cabin module 50 is mounted in the vehicle cabin 90 facing both the front seat 92 and the child seat 91. The cabin module 50 may be electrically connected to an extraneous power source. The extraneous power source includes, but is not limited to, in-vehicle cigarette lighter, etc. The main motion sensor 16 of the main module 10 and the cabin motion sensor 54 may include, but are not limited to a pyroelectric ("passive") infrared (PIR) motion sensor, and any other suitable motion sensor.

Figure 2:
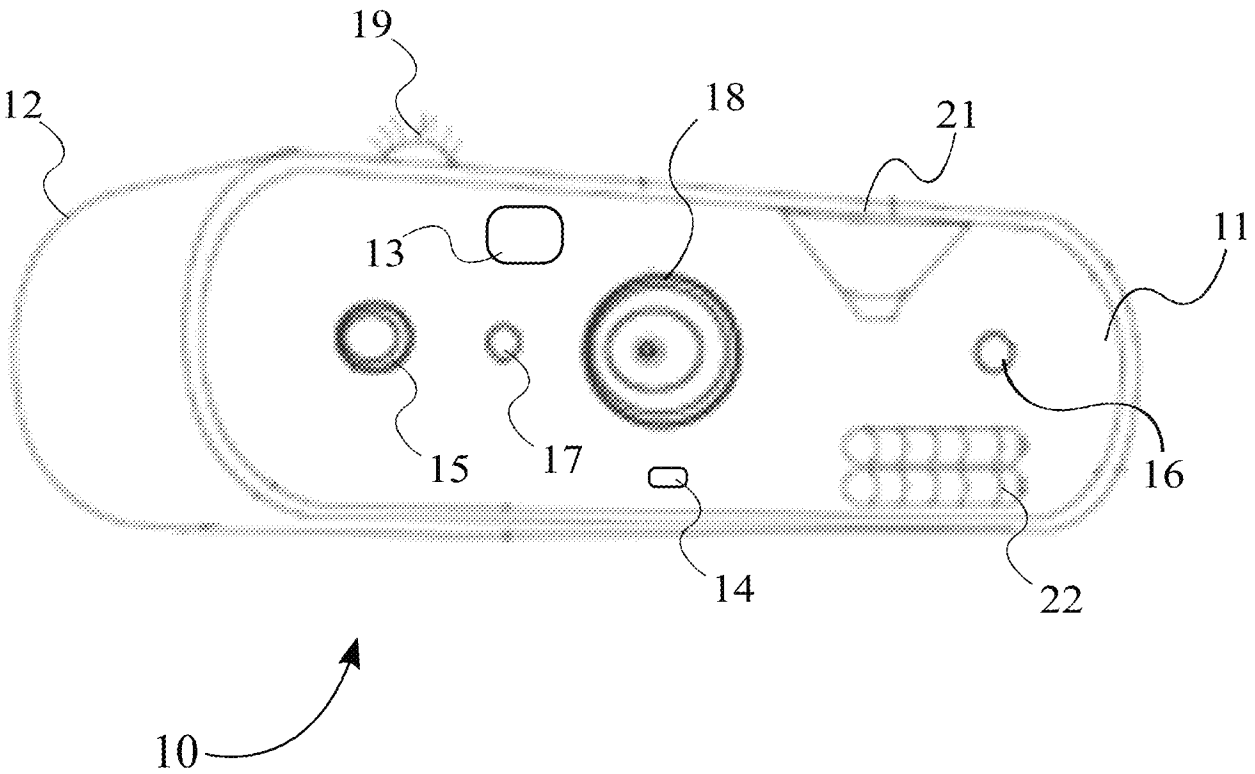
FIG. 2 is a front view of a main module of the present invention.
Figure 3:
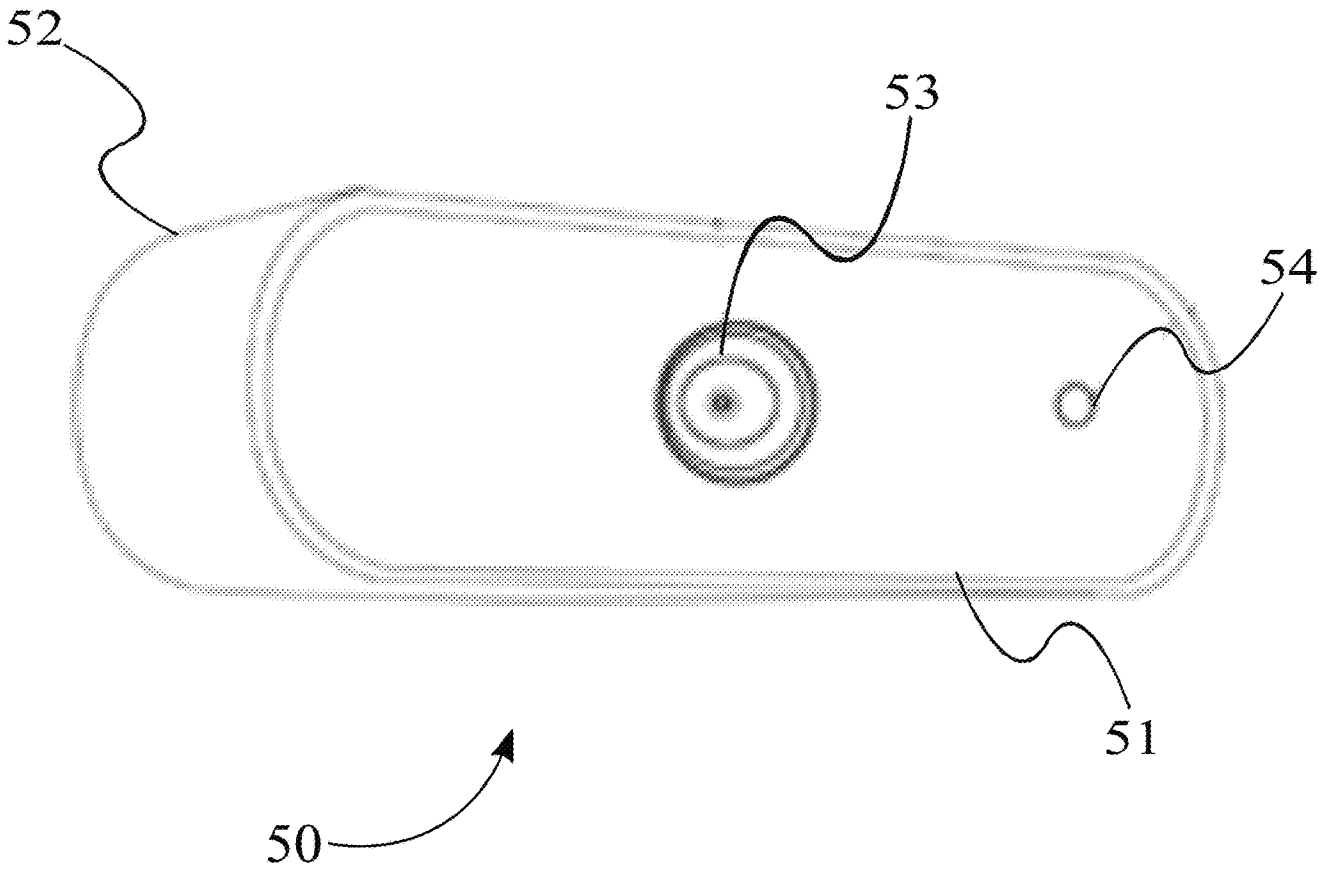
FIG. 3 is a front view of a cabin module of the present invention.
Figure 4:
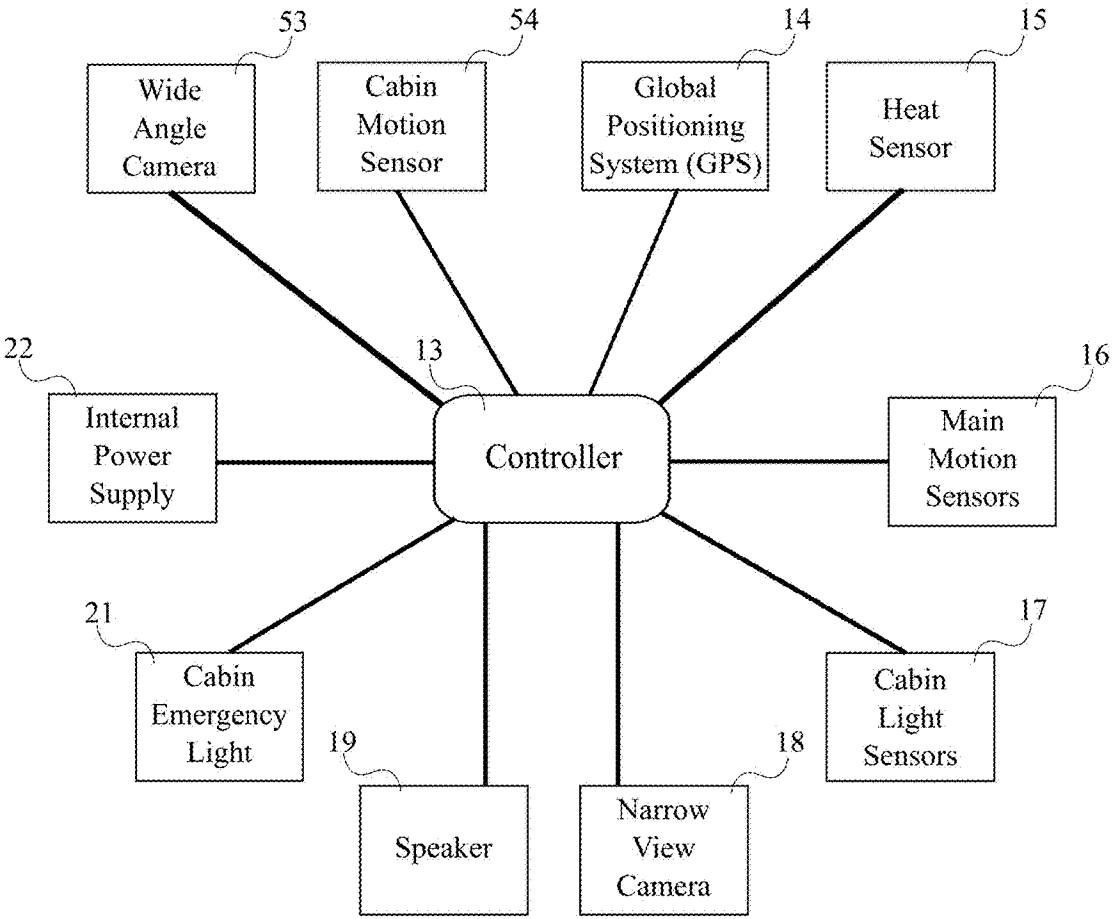
FIG. 4 is an electrical diagram of the present invention.

As can be seen in FIG. 1 to FIG. 2 and FIG. 4, the main module 10 of the AI driven smart child safety apparatus comprises a front 11, a back 12, heat sensor 15, a cabin light sensor 17, a speaker 18, a cabin emergency light 21, an internal power supply 22, and a body temperature sensor 23. The AI controller 13 of the main module 10 comprises a global system (GPS) 14. Specifically, the main module 10 is mounted to the front seat 92 of the vehicle cabin 90 through the back 12 of the main module 10. The front 11 is terminally positioned on the main module opposite the back 12 and facing the child seat 91. The heat sensor 15, the speaker 18, and the body temperature sensor 23 are mounted on the main module 10 adjacent the front 11. Additionally, the both the body temperature sensor 23 and the heat sensor being electronically connected to the AI controller 13. The cabin light sensor 17, the cabin emergency light 21, and the speaker 18 are electronically connected to the AI controller 13. The internal power supply 22 comprises at least one rechargeable battery and electrically connected to the AI controller 13. The internal power supply 22 provides continuous power to the apparatus even when the extraneous electrical source is turn off or terminated. Further, the cabin light sensor 18 may include, but is not limited to a light dependent resistor (LDR), or any other suitable light sensor.

As can be seen in FIG. 1 to FIG. 4, the cabin module 50 is mounted under a rear-view mirror inside the vehicle cabin 90. Specifically, the cabin module 50 comprises a first face 5*a* and second face 52. Specifically, the second face 52 is positioned in the front of the vehicle cabin 90 adjacent the windshield. The first face 51 is positioned opposite the second face 52 and facing all seat of the vehicle cabin 90. Both the cabin camera 53 and the cabin motion sensor 54 are mounted to the first face 51. Additionally, both the main motion sensor 16 of the main module 10 and the cabin motion sensor 53 of the cabin module 50 are electrically connected to the internal power supply 22 of the main module 10. Further, both the main motion sensor 16 of the main module 10 and the cabin motion sensor 53 of the cabin module 50 are adapted to individually turn on the power to the main module 10 if motion is detected inside the vehicle cabin 90.

As can be seen in FIG. 1 to FIG. 4, and FIG. 15 to FIG. 16, the AI controller 13 is adapted to emit an alert message at a predetermined time interval through the speaker 19 of the main module 10. The predetermined time interval may include, but is not limited to, once every five seconds, 30 seconds, one minute, etc. Additionally, the AI controller 13 is adapted to activate/turn on the cabin emergency light 21 of the main module 10 using the input of the cabin light sensor 17. The AI controller 13 comprises a face recognition module which is adapted to determine if a child is inside the vehicle cabin 90 through the at least one main camera 18 of the main module 10. The face recognition module uses AI face recognition technology to determine if a person is present in the vehicle cabin 90 and if the person present is a child or adult. A child is recognized and differentiated from an adult with a plurality of human face images and standard requirements, including, but not limited to, age, for example 12 years of age, and any other suitable requirements. The AI controller 13 is then adapted to switch or turn on the main module 10 to a power saver mode and keep the main motion sensor 16 activated if the face recognition module determines after a predetermined number of iterations with a predetermined frequency that there is no child present inside the vehicle cabin 90. The predetermined frequency includes, but is not limited to, once every second, every three seconds, etc. The predetermined number of iterations includes, but is limited to, five, 10, 15, etc. More specifically, the face recognition module is adapted to determine if an adult is inside the vehicle cabin 90 through the cabin camera 53 of the cabin module 60. The AI controller 13 is adapted to alert the corresponding PC device of the responsible adult of the vehicle for a predetermined period of time and if no adult is present inside the vehicle cabin 90. Additionally, the AI controller 13 is adapted to send emergency messages in voice, text, and/or video to a local emergency authority if no adult is present inside the vehicle cabin 90 after the predetermined period of time which includes, but is not limited to five minutes, 10 minutes, 15 minutes, etc. The voice, text, and/or video emergency messages comprise the vehicle's make and model, registered vehicle identification number, license plate number, current geographic coordinates obtained through the GPS 14 of the main module 10, and cabin temperature. Further, the AI controller 13 is adapted to send voice, text, and/or video emergency messages of the child's critical condition to the local emergency authority. The voice, text, and/or video emergency messages comprise the body temperature of the child, moving/non-moving condition, and cabin temperature.

As can be seen in FIG. 1 to FIG. 4, and FIG. 15 to FIG. 16, the AI controller 13 comprises a seatbelt pattern recognition module; that is adapted to determine if a seatbelt is securely fastened through the at least one main camera 18 of the main module 10. Specifically, the AI controller 13 is adapted to alert the corresponding PC device of a responsible adult of the vehicle with voice, text, and/or video messages through an external wireless communication network if the face recognition module determines that there is a child present inside the vehicle cabin 90, and if the seatbelt of the child seat is not securely fastened. In one alternative embodiment of the present invention, the AI controller 13 is adapted to alert the corresponding PC device of the responsible user of the vehicle if the seatbelt of the child seat is securely fastened but the vehicle speed exceeds a predetermined value based on the GPS 14 input for the local or highway maximum allowed speed. In another embodiment of the present invention, the AI controller 13 is adapted to alert the corresponding PC device of the responsible user of the vehicle if the seatbelt of the child seat is securely fastened but the vehicle cabin temperature measured through the heat sensor 15 of the main module 10 falls out of a predetermined range, including, but not limited to, a safe CDC (center of disease control) regulation range of 10° F. to 80° F. 35° F. to 85° F., and any other suitable range, to prevent sudden infant death syndrome (SIDS) and any other related danger to the child. In another embodiment of the present invention, the AI controller 13 is adapted to alert the corresponding PC device of the responsible user of the vehicle if the seatbelt of the child seat is securely fastened but the child body temperature measured through the body temperature sensor 23 of the main module 10 exceeds a predetermined value, including, but not limited to, 104° F., or any other suitable value.

As can be seen in FIG. 5 to FIG. 16, the method for facilitating the AI driven smart child safety for a motor vehicle of the present invention provides an innovative system and process to monitor and ensure a child's safety. To accomplish this, the method of the present invention provides a main module mounted to a cabin of the vehicle facing a child seat, wherein the main module comprises an AI controller, a main motion sensor, and a main camera, and wherein both the main motion sensor and the main camera are electronically connected to the AI controller, and wherein the main motion sensor is powered by a backup battery (Step A). Additionally, the method provides a cabin module mounted to the front of the vehicle cabin facing all seats, wherein the cabin module comprises a cabin motion sensor and a cabin camera, and wherein both the cabin motion sensor and the cabin camera are electronically connected to the AI controller (Step B).

Figure 6:
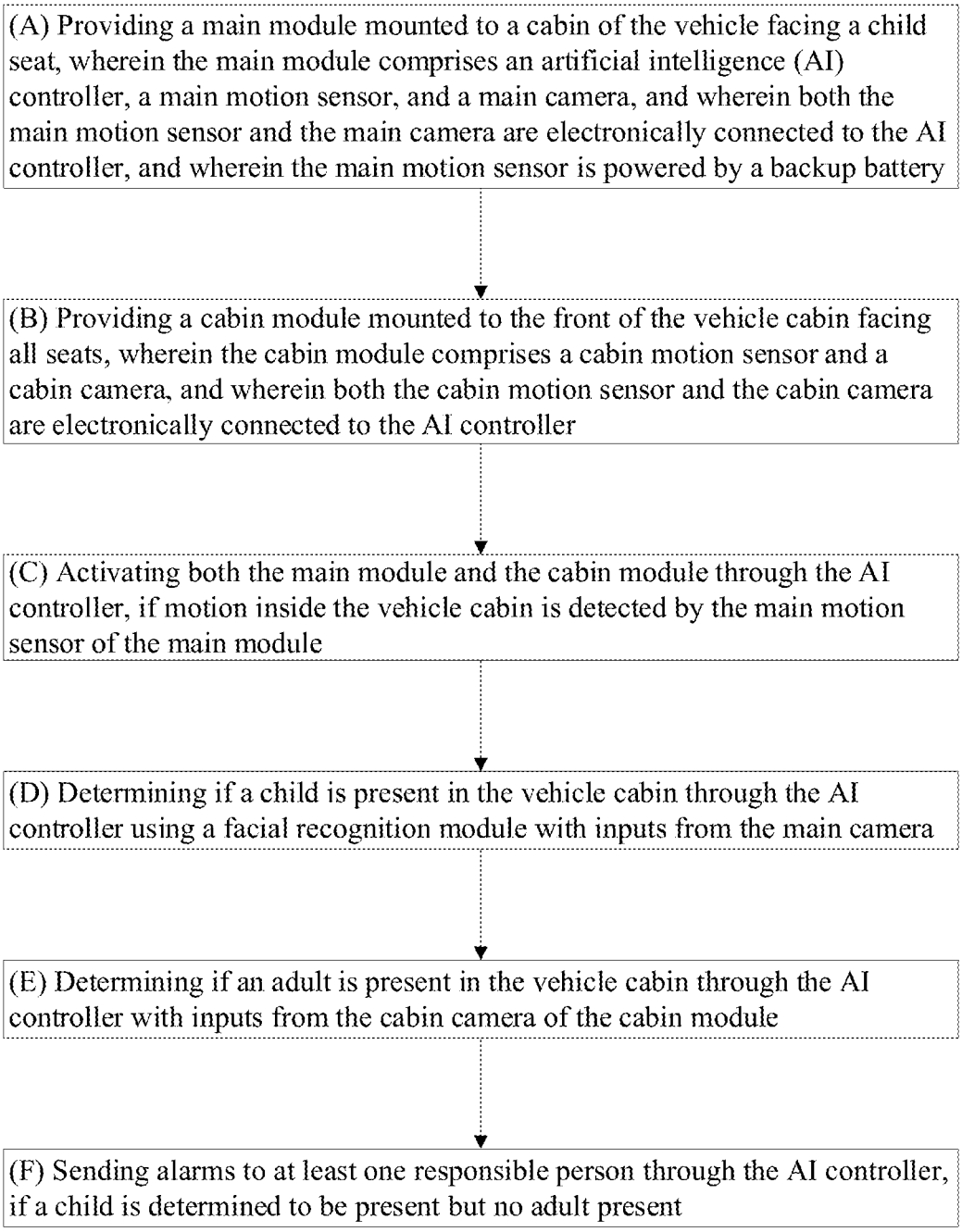
FIG. 6 is flow diagram of the overall process of the method of the present invention.

As can be seen in FIG. 6, the overall process of the method starts with activating both the main module and the cabin module through the AI controller, if motion inside the vehicle cabin is detected by the main motion sensor of the main module (Step C). Subsequently, the method determines if a child is present in the vehicle cabin through the AI controller using a facial recognition module with inputs from the main camera (Step D), and determines if an adult is present in the vehicle cabin through the AI controller with inputs from the cabin camera of the cabin module (Step E). Immediately, the method sending alarms to at least one responsible person through the AI controller, if a child is determined to be present but no adult present (Step F).

Figure 7:
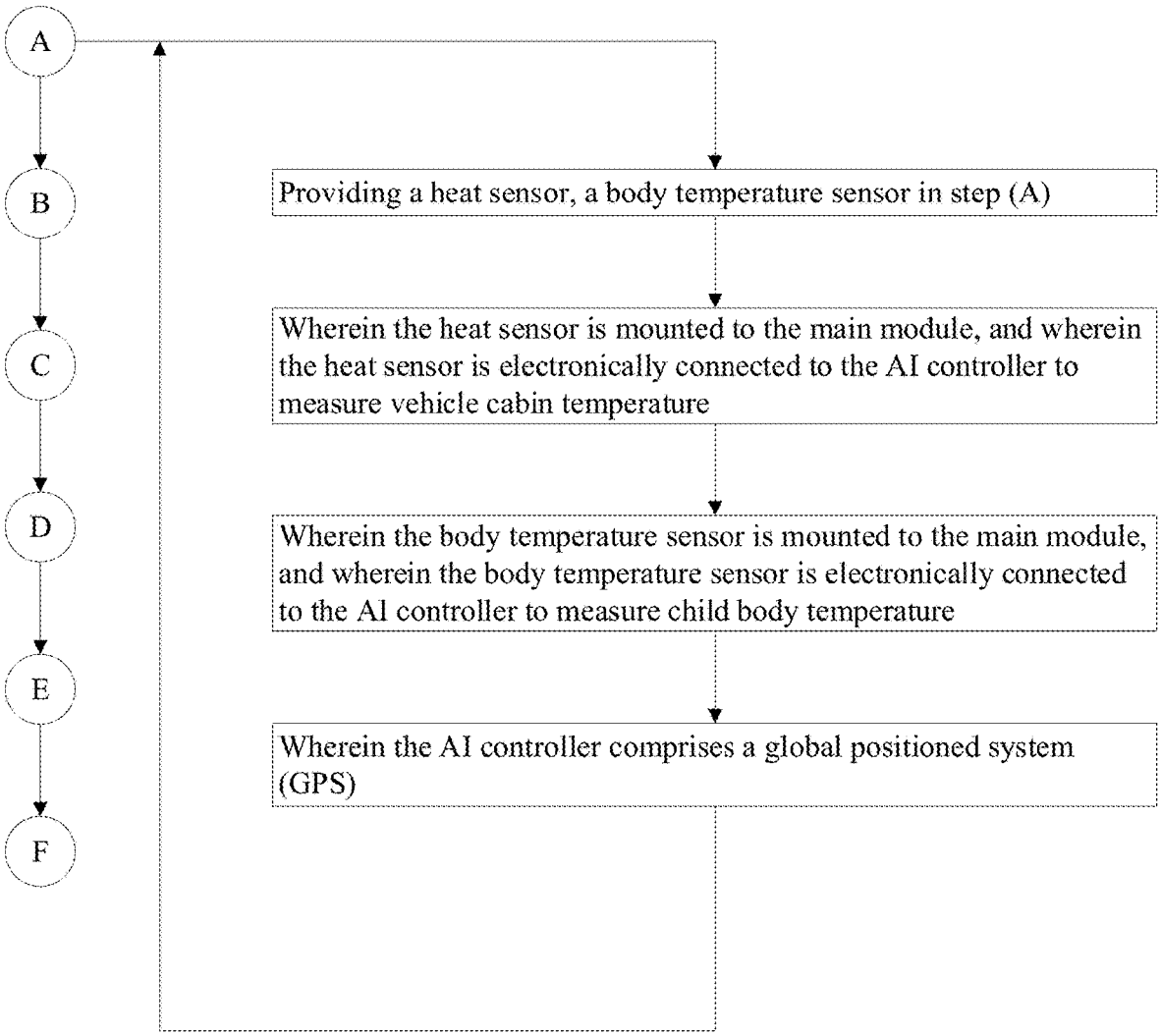
FIG. 7 is flow diagram of components for the Step A of the method of the present invention.
Figure 8:
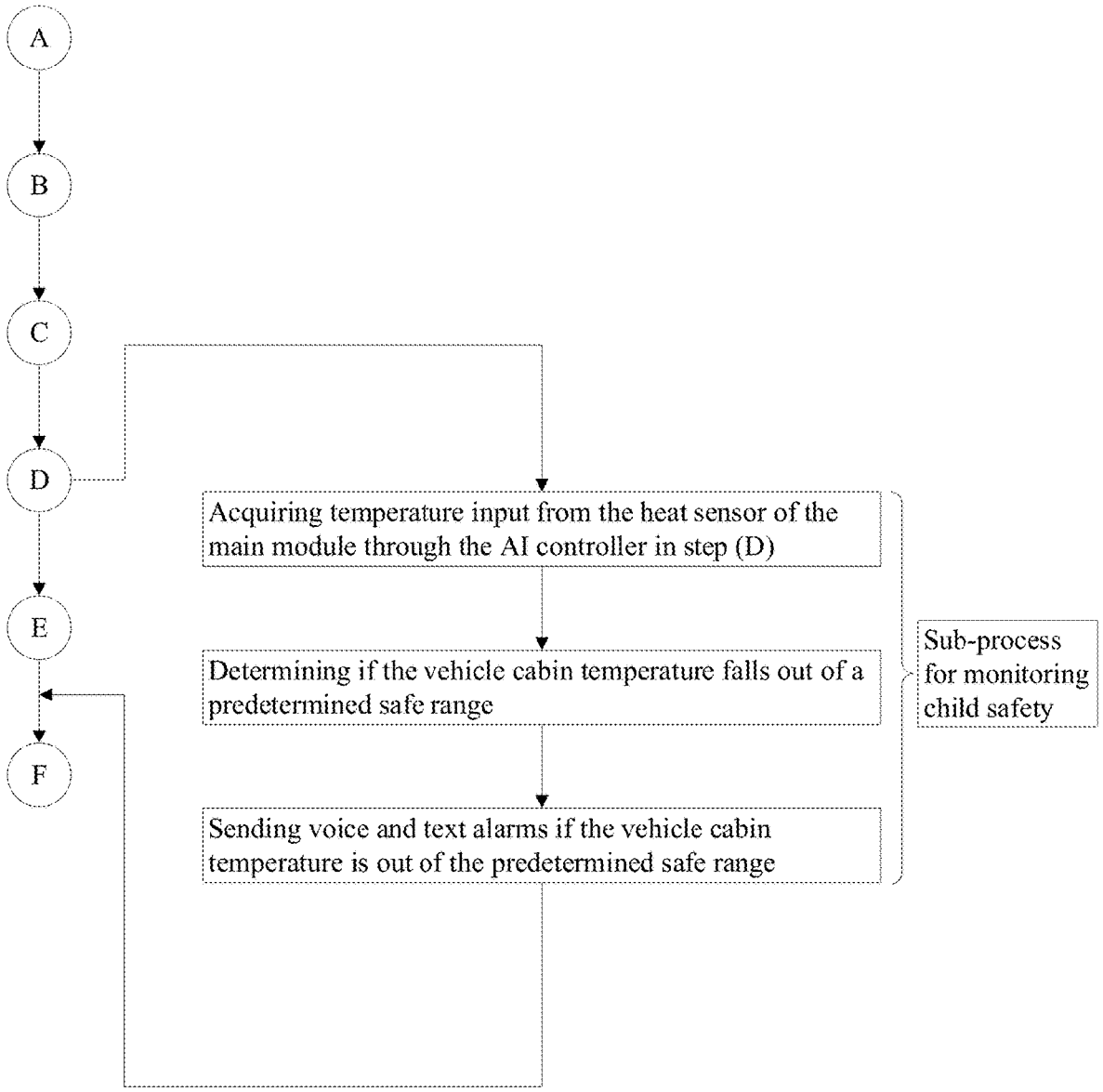
FIG. 8 is flow diagram of a sub-process for monitoring child safety of the method of the present invention, wherein the vehicle cabin temperature is being monitored.

As can be seen in FIG. 7, in an alternative embodiment, the method of the present invention provides a heat sensor, a body temperature sensor in Step A, wherein the heat sensor is mounted to the main module, and wherein the heat sensor is electronically connected to the AI controller to measure vehicle cabin temperature. Additionally, the body temperature sensor is mounted to the main module, and the body temperature sensor is electronically connected to the AI controller to measure child body temperature. Further, the AI controller comprises a global positioned system (GPS), which provides inputs to the AI controller, including, but not limited to, accurate geographic coordinates and speed of the vehicle.

Figure 9:
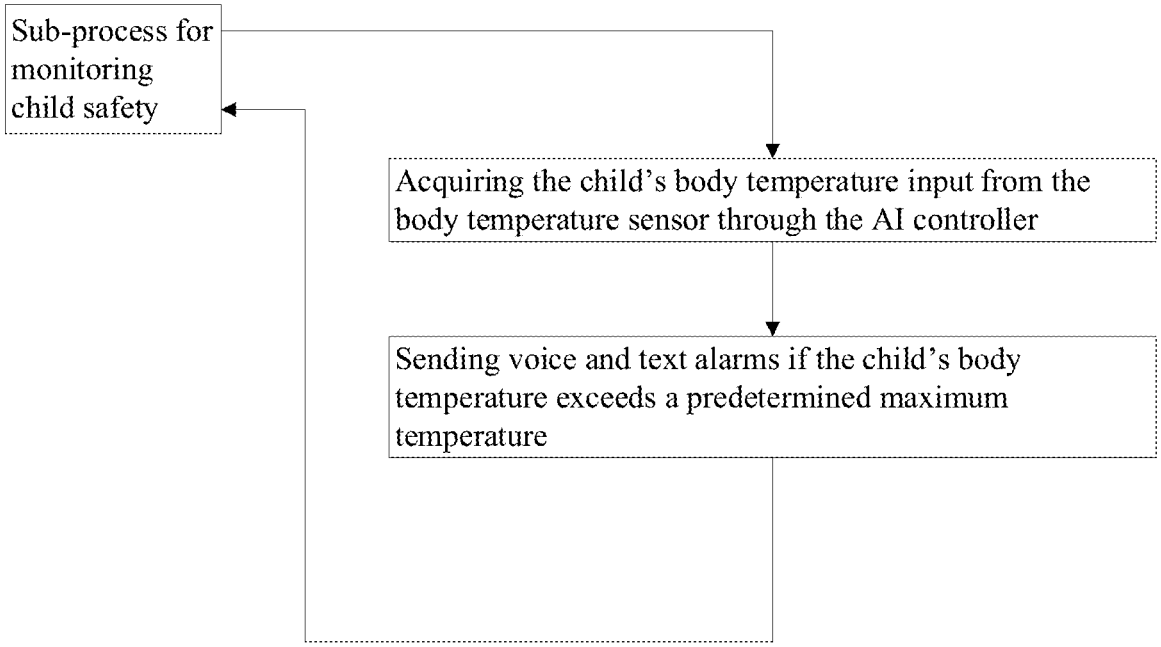
FIG. 9 is flow diagram of an alternative embodiment of the sub-process for monitoring child safety of the method of the present invention, wherein the child body temperature is being monitored.
Figure 10:
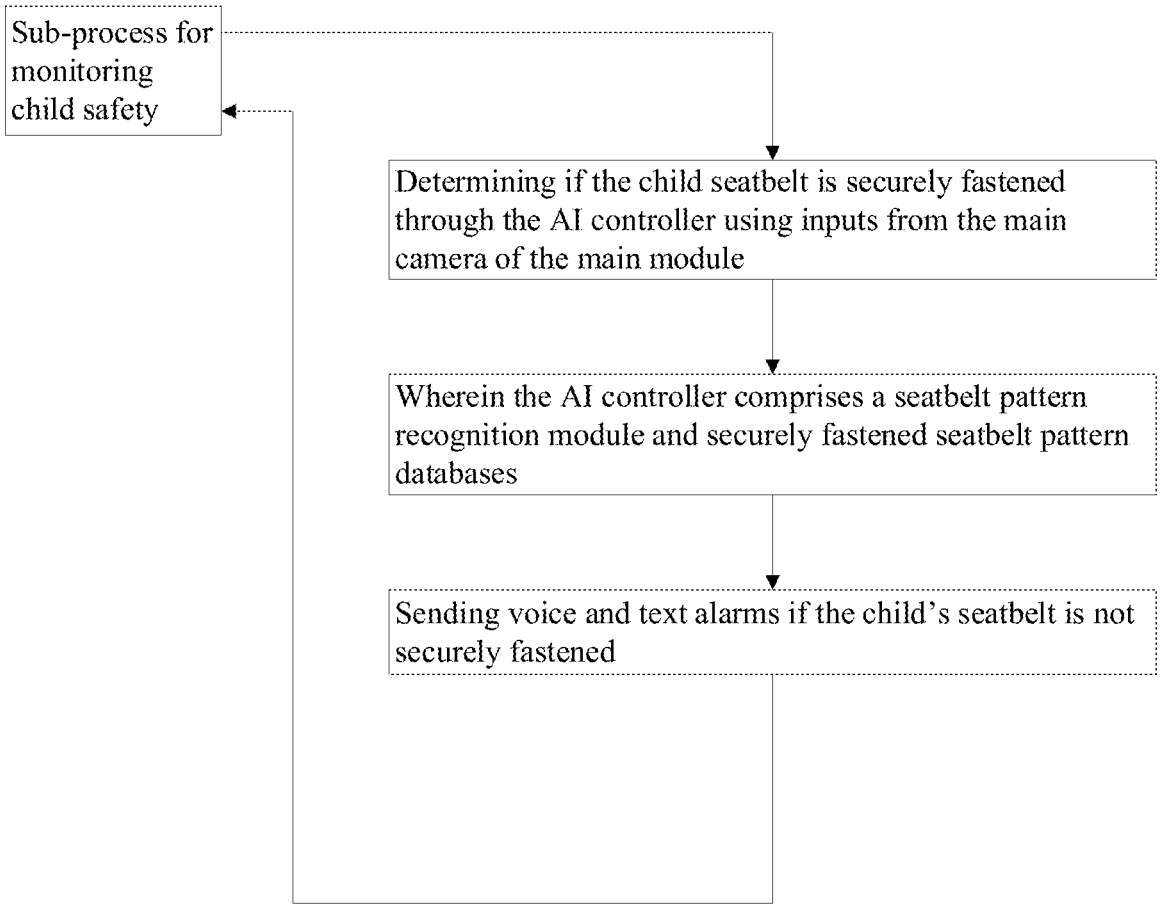
FIG. 10 is flow diagram of another embodiment of the sub-process for monitoring child safety of the method of the present invention, wherein the child seatbelt is being monitored.
Figure 11:
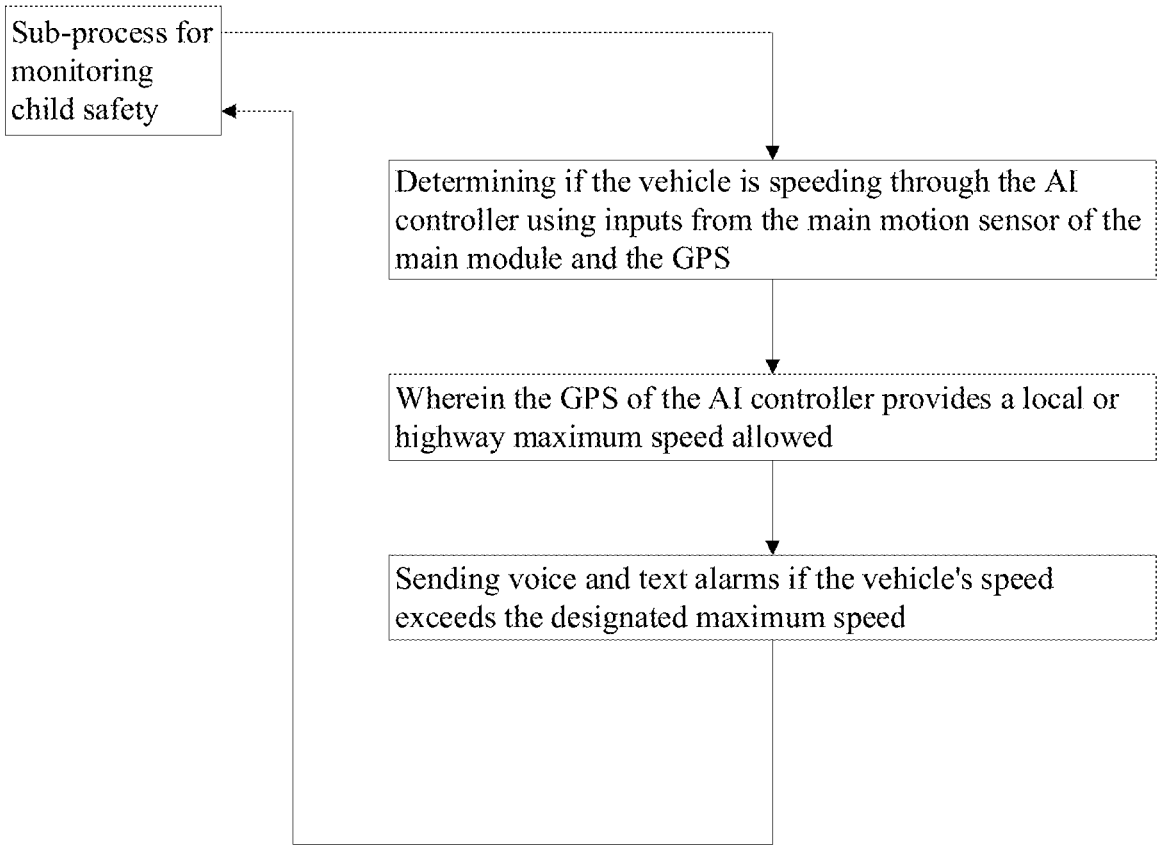
FIG. 11 is flow diagram of another embodiment of the sub-process for monitoring child safety of the method of the present invention, wherein the vehicle's speed is being monitored.
Figure 12:
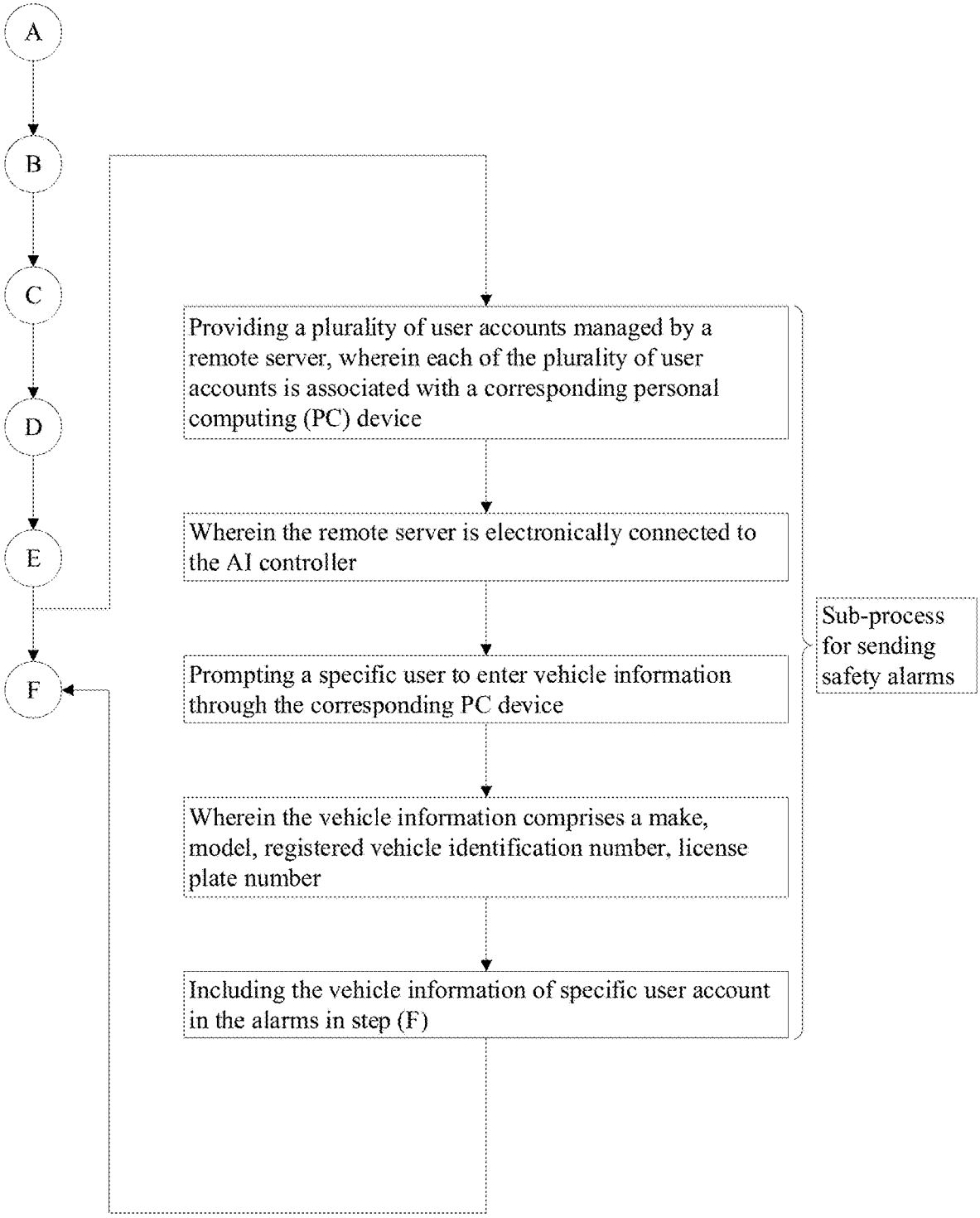
FIG. 12 is flow diagram of a sub-process for sending safety alarms of the method of the present invention.

As can be seen in FIG. 8 to FIG. 11, the method of the present invention provides a sub-process for monitoring the child's safety in the vehicle. Specifically, as can be in in FIG. 8, the method acquires temperature input from the heat sensor of the main module through the AI controller in Step D and determines if the vehicle cabin temperature falls out of a predetermined safe range, including, but not limited to, 35° F. to 90° F., and any other suitable range. Immediately, the method sends voice/text/video alarms if the vehicle cabin temperature is out of the predetermined safe range. As can be seen in FIG. 9, in an alternative embodiment, the method acquires the child's body temperature input from the body temperature sensor through the AI controller and sends voice/text/video alarms if the child's body temperature exceeds a predetermined maximum temperature, including, but not limited to, 104° F., and any other suitable value. As can be seen in FIG. 10, in another embodiment, the method determines if the child seatbelt is securely fastened through the AI controller using inputs from the main camera of the main module, wherein the AI controller comprises a seatbelt pattern recognition module and securely fastened seatbelt pattern databases. Immediately, the method sends voice/text/video alarms if the child's seatbelt is not securely fastened. As can be seen in FIG. 10, in yet another embodiment, the method determines if the vehicle is speeding through the AI controller using inputs from the main motion sensor of the main module and the GPS, wherein the GPS of the AI controller provides a local or highway maximum speed allowed. Immediately, the method sends out voice/text/video alarms if the vehicle's speed exceeds the designated maximum speed.

Figure 5:
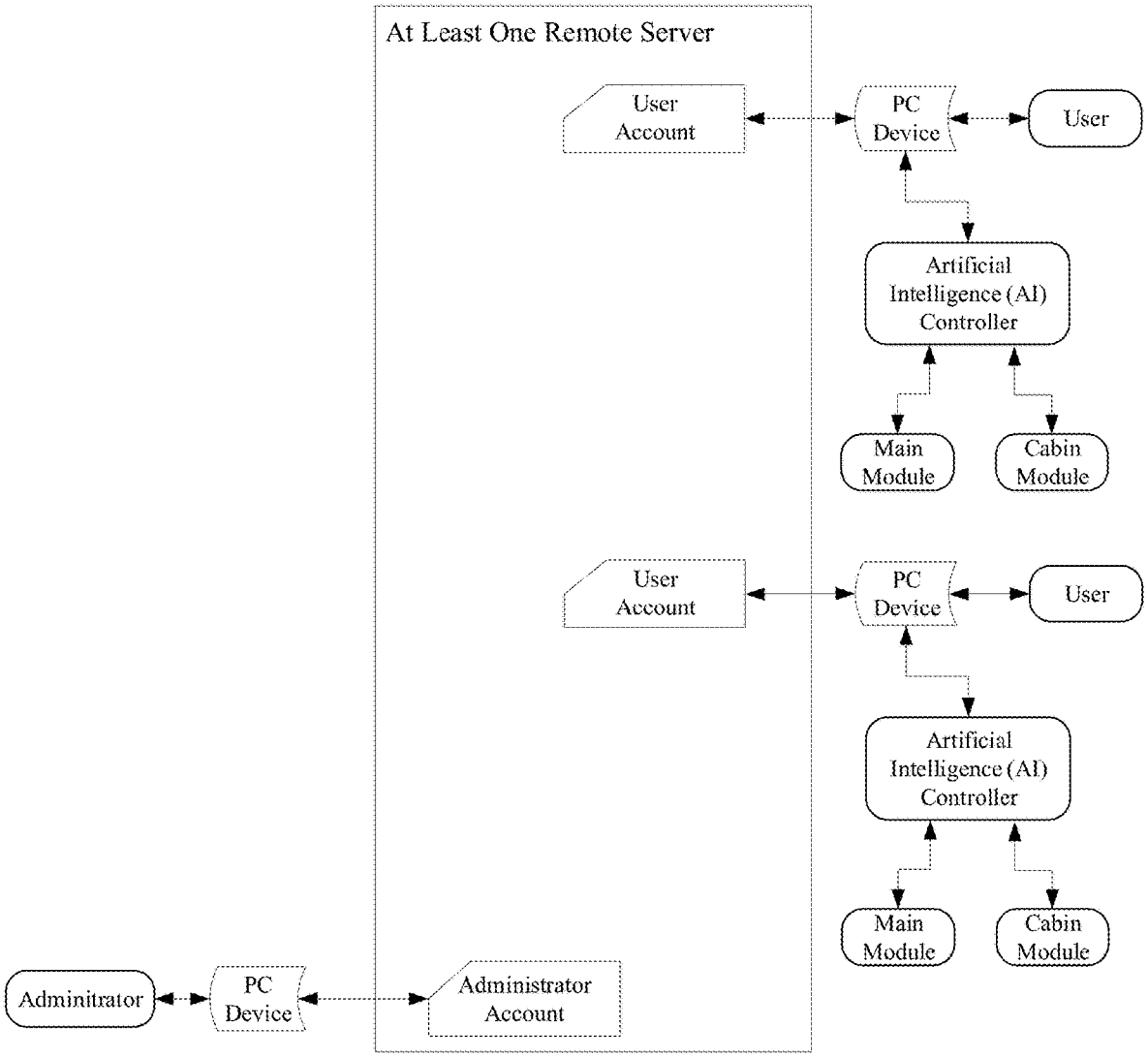
FIG. 5 is system diagram of the method of the present invention.

As can be seen in FIG. 5, and FIG. 12 to FIG. 14, the method of the present invention provides a sub-process for sending safety alarms. Specifically, as can be in FIG. 5 and FIG. 12, the method provides a plurality of user accounts managed by a remote server, wherein each of the plurality of user accounts is associated with a corresponding personal computing (PC) device. Additionally, the remote server is electronically connected to the AI controller and prompts a specific user to enter vehicle information through the corresponding PC device, wherein the vehicle information comprises a make, model, registered vehicle identification number, license plate number. Subsequently, the method includes the vehicle information of specific user account in the alarms in Step F. More specifically, each of the plurality of user accounts is associated with a corresponding PC device. The corresponding PC device allows a user to interact with the present invention and can be, but is not limited to, a smartphone, a smart watch, a cloud PC, a laptop, a desktop, a server, a terminal PC, or a tablet PC, etc. The users of the user accounts may include relevant parties such as, but are not limited to, individuals, consumers, vehicle buyers, vehicle owners, car dealers, car dealership, vehicle marketing/sales professionals, officials, safety authorities, traffic patrol officials, police officers, managers, business owners, companies, corporations, management companies, sellers, lessors, police department, care centers, care professionals, hospitals, doctors, nurses, first responders, government entities, administrators, etc. Further, the at least one remote server is used to manage the AI driven smart child safety platform for the plurality of user accounts. The remote server can be managed through an administrator account by an administrator as seen in FIG. 5. The administrator who manages the remote server includes, but is not limited to, technician, engineer, system engineer, system specialist, software engineer, information technology (IT) engineer, IT professional, IT manager, IT consultant, service desk professional, service desk manager, consultant, manager, executive officer, chief operating officer, chief technology officer, chief executive officer, president, company, corporation, organization, etc. Moreover, the remote server is used to execute a number of internal software processes and store data for the present invention. The software processes may include, but are not limited to, server software programs, web-based software applications or browsers embodied as, for example, but not limited to, websites, web applications, desktop applications, cloud applications, and mobile applications compatible with a corresponding user PC device. Additionally, the software processes may store data into the AI controller, internal databases and communicate with external databases, which may include but are not limited to map databases (such as Google Maps®), motor vehicle databases, child safety databases, child health databases, car safety databases, other suitable databases, databases maintaining data about geographical coordinates and addresses, databases maintaining data about motor vehicle registration information, databases maintaining data about traffic laws/rules/regulations, etc. The interaction with external databases over a communication network may include, but is not limited to, the Internet.

Figure 13:
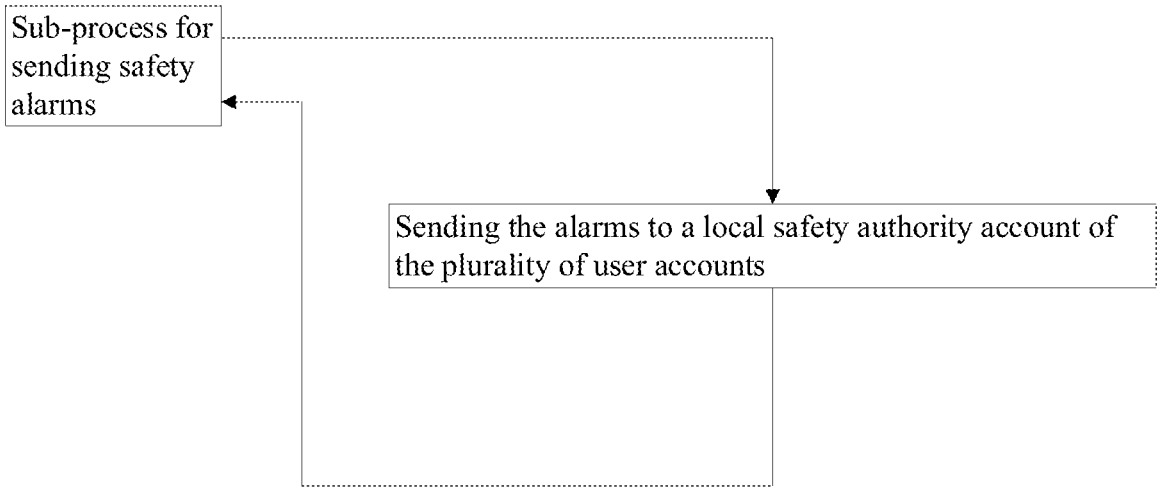
FIG. 13 is flow diagram of an alternative embodiment of the sub-process for sending safety alarms of the method of the present invention, wherein the alarms are sent to a local safety authority.
Figure 14:
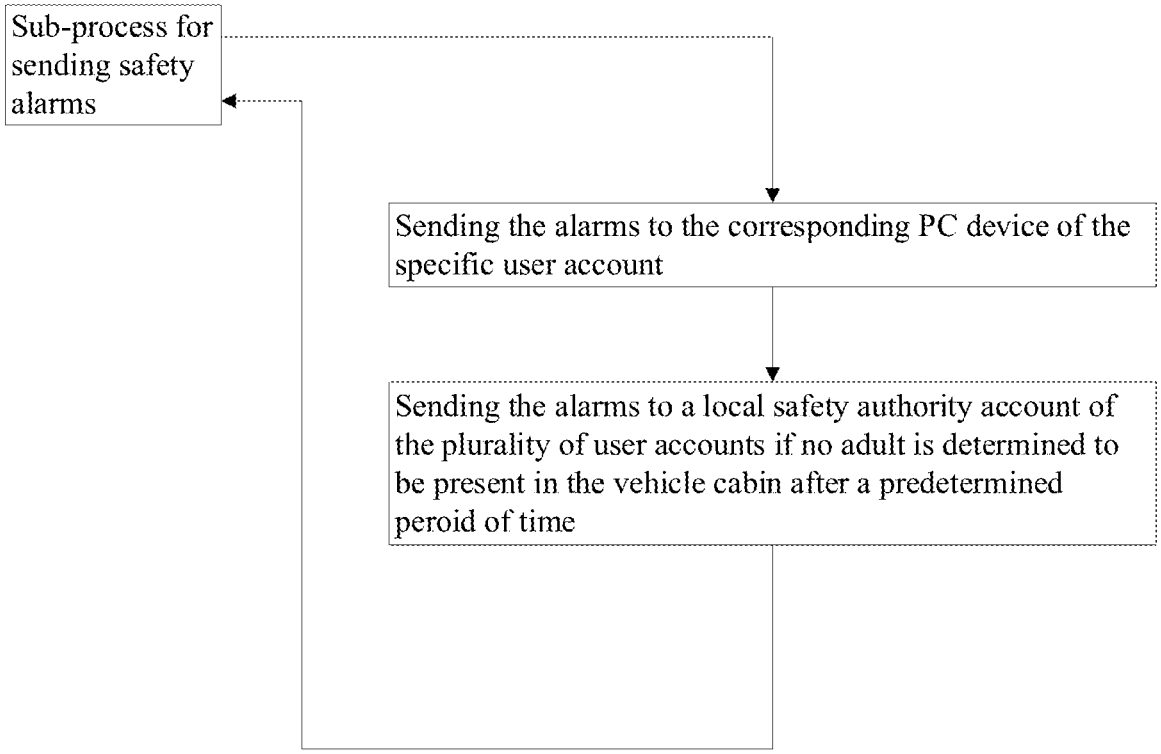
FIG. 14 is flow diagram of another embodiment of the sub-process for sending safety alarms of the method of the present invention, wherein the alarms are sent to a local safety authority if an unsafe condition or emergency still exists after a predetermined period of time.
Figure 15:
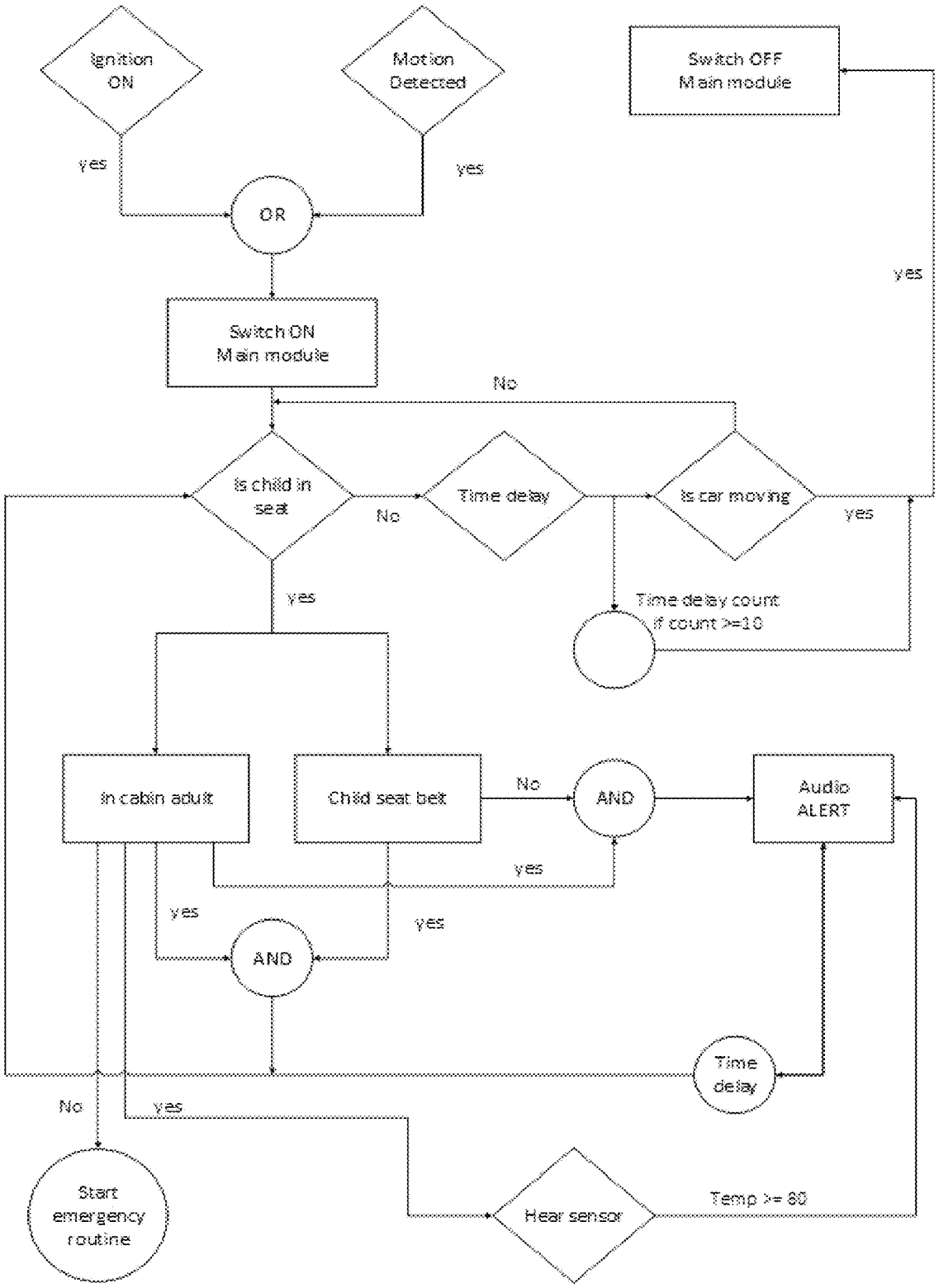
FIG. 15 is a flow diagram depicting how the present invention's artificial intelligence (AI) module works.
Figure 16:
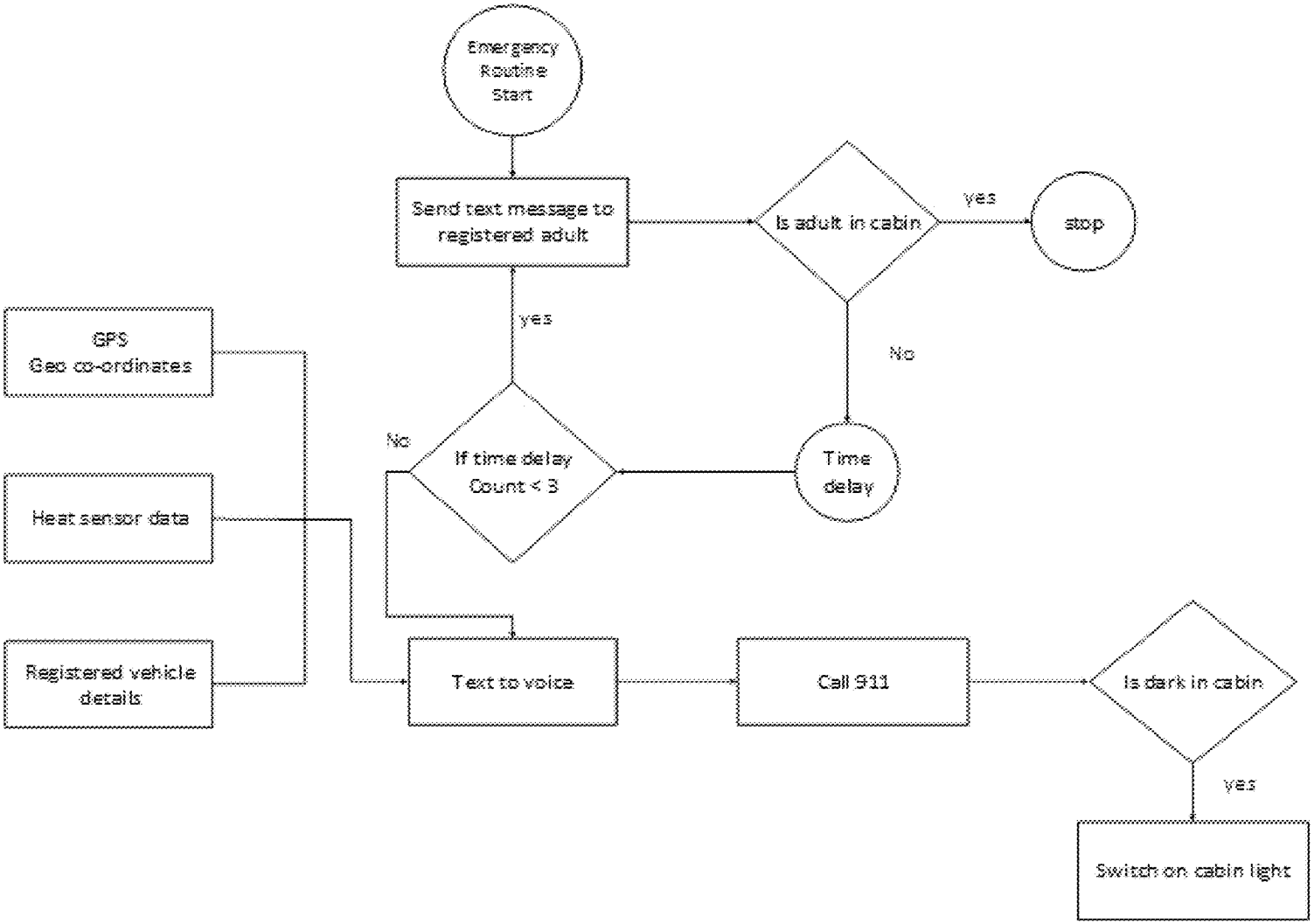
FIG. 16 is a flow diagram depicting how the present invention's emergency routine works.

As can be seen in FIG. 13, the method sends the voice/text/video alarms to a local safety authority account of the plurality of user accounts. AS can be seen in FIG. 14, in an alternative embodiment, the method sends the voice/text/video alarms to the corresponding PC device of the specific user account. Subsequently, the method may send the voice/text/video alarms to a local safety authority account of the plurality of user accounts if no adult is determined to be present in the vehicle cabin after a predetermined period of time, including, but not limited to, three minutes, five minute, ten minutes, etc.

Emergency Routine:

1. 3 text and voice warning messages are transmitted to registered mobile device—setting by the use in your system in pre-programmed time intervals;
2. If the cabin light is low, in cabin module lights will be activated; —night time
3. If child safe conditions are not detected within the pre-programmed time intervals—20 minutes, the automobile's make and model, current geo-coordinates—GPS part of the processor of the module, registered vehicle identification number, license plate number, in cabin temperature will be informed to local emergency authorities via voice and text message; 22 states receiving text 911 message; Cabin module has cellular data connection using a SIM (subscriber identity module) card, and
4. If after (say 15 minutes) notifying local emergency authorities, the temperature exceeds safe levels imposed by the government, the local authorities shall be notified again of critical condition/high emergency situation. Message includes the current status of the child—moving or not moving, cabin temperature, and kid body temperature.

Although the invention has been explained in relation to its preferred embodiment, it is to be understood that many other possible modifications and variations can be made without departing from the spirit and scope of the invention as hereinafter claimed.

What is claimed is:

1. An artificial intelligence driven smart child safety system for a motor vehicle comprising:

a main module;

a cabin module;

a vehicle cabin;

the vehicle cabin comprising a front seat and a child seat;

the front seat being mounted inside the vehicle cabin;

the child seat being positioned in the vehicle cabin opposite the front seat;

the main module being electronically connected to an extraneous power source;

the main module comprising an artificial intelligence (AI) controller, a main motion sensor, at least one main camera;

the AI controller being electronically connected with the main motion sensor and the at least one main camera;

the cabin module comprising a cabin camera and a cabin motion sensor;

the cabin camera and the cabin motion sensor being electronically connected to the AI controller of the main module;

the main module being mounted to the front seat facing the child seat of the vehicle cabin; and the cabin module being mounted in the vehicle cabin facing both the front seat and the child seat.

2. The artificial intelligence driven smart child safety system for a motor vehicle as claimed in claim 1 comprising:

the main module comprising a heat sensor and a body temperature sensor;

both the body temperature sensor and the heat sensor being electronically connected to the AI controller; and the AI controller comprising a global system (GPS).

3. The artificial intelligence driven smart child safety system for a motor vehicle as claimed in claim 1 comprising:

the main module comprising a cabin light sensor, a cabin emergency light, and a speaker; and the cabin light sensor, the cabin emergency light, and the speaker being electronically connected to the AI controller.

4. The artificial intelligence driven smart child safety system for a motor vehicle as claimed in claim 3 comprising:

the AI controller being adapted to emit an alert message at a predetermined time interval through the speaker of the main module; and the AI controller being adapted to activate the cabin emergency light of the main module using the input of the cabin light sensor.

5. The artificial intelligence driven smart child safety system for a motor vehicle as claimed in claim 1 comprising:

the main module comprising an internal power supply;

the internal power supply comprising at least one rechargeable battery; and the internal power supply being electrically connected to the AI controller.

6. The artificial intelligence driven smart child safety system for a motor vehicle as claimed in claim 1 comprising:

the cabin module being mounted under the rear-view mirror inside the vehicle cabin.

7. The artificial intelligence driven smart child safety system for a motor vehicle as claimed in claim 6 comprising:

the main motion sensor of the main module being electrically connected to the internal power supply;

the cabin motion sensor of the cabin module being electrically connected to the internal power supply; and both the main motion sensor and the cabin motion sensor being adapted to individually turn on the power to the main module if motion is detected inside the vehicle cabin.

8. The artificial intelligence driven smart child safety system for a motor vehicle as claimed in claim 1 comprising:

the AI controller comprising a face recognition module; and the face recognition module being adapted to determine if a child is inside the cabin through the at least one main camera of the main module.

9. The artificial intelligence driven smart child safety system for a motor vehicle as claimed in claim 8 comprising:

the AI controller being adapted to switch the main module to a power saver mode and keep the main motion sensor activated;

if the face recognition module determines after a predetermined number of iterations with a predetermined frequency that there is no child present inside the vehicle cabin.

10. The artificial intelligence driven smart child safety system for a motor vehicle as claimed in claim 8 comprising:

the AI controller comprising a seatbelt pattern recognition module;

the seatbelt pattern recognition module is adapted to determine if a seatbelt is securely fastened through the at least one main camera of the main module;

the AI controller being adapted to alert the corresponding personal computing (PC) device of a responsible adult of the vehicle cabin with voice and text messages through an external wireless communication network;

if the face recognition module determines that there is a child present inside the vehicle cabin; and if the seatbelt of the child seat is not securely fastened.

11. The artificial intelligence driven smart child safety system for a motor vehicle as claimed in claim 10 comprising:

the AI controller being adapted to alert the corresponding personal computing (PC) device of the responsible user of the vehicle;

if the seatbelt of the child seat is securely fastened; and if the vehicle speed exceeds a predetermined value.

12. The artificial intelligence driven smart child safety system for a motor vehicle as claimed in claim 10 comprising:

the AI controller being adapted to alert the corresponding personal computing (PC) device of the responsible adult of the vehicle;

if the seatbelt of the child seat is securely fastened; and if the vehicle cabin temperature measured through the heat sensor of the main module exceeds a predetermined value.

13. The artificial intelligence driven smart child safety system for a motor vehicle as claimed in claim 10 comprising:

the AI controller being adapted to alert the corresponding personal computing (PC) device of a responsible adult of the vehicle;

if the seatbelt of the child seat is securely fastened; and if the child body temperature measured through the body temperature sensor of the main module exceeds a predetermined value.

14. The artificial intelligence driven smart child safety system for a motor vehicle as claimed in claim 10 comprising:

the face recognition module being adapted to determine if an adult is inside the vehicle cabin through the cabin camera of the cabin module;

the AI controller being adapted to alert the corresponding personal computing (PC) device of the responsible adult of the vehicle for a predetermined period of time; and if no adult is present inside the vehicle cabin.

15. The artificial intelligence driven smart child safety system for a motor vehicle as claimed in claim 14 comprising:

the AI controller being adapted to send emergency messages in voice and text to a local emergency authority;

if no adult is present inside the vehicle cabin after the predetermined period of time; and both the voice and text emergency messages comprising the vehicle's make and model, registered vehicle identification number, license plate number, current geographic coordinates obtained through the GPS of the main module, and cabin temperature.

16. The artificial intelligence driven smart child safety system for a motor vehicle as claimed in claim 15 comprising:

the AI controller being adapted to send voice and text emergency messages of the child's critical condition to the local emergency authority; and both the voice and text emergency messages comprising the body temperature of the child, moving/non-moving condition, and cabin temperature.

17. A method of facilitating artificial intelligence driven smart child safety for a motor vehicle, the method comprising the steps of:

(A) providing a main module mounted to a cabin of the vehicle facing a child seat, wherein the main module comprises an artificial intelligence (AI) controller, a main motion sensor, and a main camera, and wherein both the main motion sensor and the main camera are electronically connected to the AI controller, and wherein the main motion sensor is powered by a backup battery;

(B) providing a cabin module mounted to the front of the vehicle cabin facing all seats, wherein the cabin module comprises a cabin motion sensor and a cabin camera, and wherein both the cabin motion sensor and the cabin camera are electronically connected to the AI controller;

(C) Activating both the main module and the cabin module through the AI controller, if motion inside the vehicle cabin is detected by the main motion sensor of the main module;

(D) Determining if a child is present in the vehicle cabin through the AI controller using a facial recognition module with inputs from the main camera;

(E) Determining if an adult is present in the vehicle cabin through the AI controller with inputs from the cabin camera of the cabin module; and (F) Sending voice/text/video alarms to at least one responsible person through the AI controller, if a child is determined to be present but no adult present.

18. The method of facilitating artificial intelligence driven smart child safety for a motor vehicle as claimed in claim 17 comprising the steps of:

providing a heat sensor, a body temperature sensor in step (A);

wherein the heat sensor is mounted to the main module, and wherein the heat sensor is electronically connected to the AI controller to measure vehicle cabin temperature;

wherein the body temperature sensor is mounted to the main module, and wherein the body temperature sensor is electronically connected to the AI controller to measure child body temperature; and where the AI controller comprises a global positioned system (GPS).

19. The method of facilitating artificial intelligence driven smart child safety for a motor vehicle as claimed in claim 18 comprising the steps of:

acquiring temperature input from the heat sensor of the main module through the AI controller in step (D);

determining if the vehicle cabin temperature falls out of a predetermined safe range; and sending the voice/text/video alarms if the vehicle cabin temperature is out of the predetermined safe range.

20. The method of facilitating artificial intelligence driven smart child safety for a motor vehicle as claimed in claim 18 comprising the steps of:

acquiring the child's body temperature input from the body temperature sensor through the AI controller; and sending the voice/text/video alarms if the child's body temperature exceeds a predetermined maximum temperature.

21. The method of facilitating artificial intelligence driven smart child safety for a motor vehicle as claimed in claim 18 comprising the steps of:

determining if the child seatbelt is securely fastened through the AI controller using inputs from the main camera of the main module;

wherein the AI controller comprises a seatbelt pattern recognition module and securely fastened seatbelt pattern databases; and sending the voice/text/video alarms if the child's seatbelt is not securely fastened.

22. The method of facilitating artificial intelligence driven smart child safety for a motor vehicle as claimed in claim 18 comprising the steps of:

determining if the vehicle is speeding through the AI controller using inputs from the main motion sensor of the main module and the GPS;

wherein the GPS of the AI controller provides a local or highway maximum speed allowed; and sending the voice/text/video alarms if the vehicle's speed exceeds the designated maximum speed.

23. The method of facilitating artificial intelligence driven smart child safety for a motor vehicle as claimed in claim 17 comprising the steps of:

providing a plurality of user accounts managed by a remote server, wherein each of the plurality of user accounts is associated with a corresponding personal computing (PC) device;

wherein the remote server is electronically connected to the AI controller;

prompting a specific user to enter vehicle information through the corresponding PC device;

wherein the vehicle information comprises a make, model, registered vehicle identification number, license plate number; and including the vehicle information of specific user account in the alarms in step (F).

24. The method of facilitating artificial intelligence driven smart child safety for a motor vehicle as claimed in claim 23 comprising the steps of:

sending the voice/text/video alarms to a local safety authority account of the plurality of user accounts.

25. The method of facilitating artificial intelligence driven smart child safety for a motor vehicle as claimed in claim 23 comprising the steps of:

sending the voice/text/video alarms to the corresponding PC device of the specific user account; and sending the voice/text/video alarms to a local safety authority account of the plurality of user accounts if no adult is determined to be present in the vehicle cabin after a predetermined period of time.

* * * * *